US007350861B2

(12) United States Patent
Zaharakos

(10) Patent No.: US 7,350,861 B2
(45) Date of Patent: Apr. 1, 2008

(54) TEXTILE COMPONENT

(75) Inventor: Anna E. Zaharakos, Grand Rapids, MI (US)

(73) Assignee: Studio Z Textiles, Grand Rapids, MI (US)

( * ) Notice: Subject to any disclaimer, the term of this patent is extended or adjusted under 35 U.S.C. 154(b) by 501 days.

(21) Appl. No.: 10/913,741

(22) Filed: Aug. 6, 2004

(65) Prior Publication Data

US 2006/0103196 A1 May 18, 2006

(51) Int. Cl.
*A47C 31/11* (2006.01)

(52) U.S. Cl. ..... 297/228.1; 297/219.1; 66/170; 138/384 R

(58) Field of Classification Search ..... 297/219.1, 297/228.1; 66/170, 171, 176, 177, 195, 196; 139/383 R, 384 R
See application file for complete search history.

(56) References Cited

U.S. PATENT DOCUMENTS 3,985,003 A * 10/1976 Reed ..... 66/196
6,349,750 B1 2/2002 Fujiwara
6,453,705 B2 * 9/2002 Fujiwara ..... 66/176
6,499,801 B1 12/2002 Peterson et al.
6,523,968 B1 * 2/2003 Walker ..... 362/103
6,823,700 B1 * 11/2004 Yi ..... 66/192

OTHER PUBLICATIONS

Steelcase, "Seating : Leap," Product Brochure, Sep. 3, 2003.

* cited by examiner

*Primary Examiner*—Peter R. Brown
(74) *Attorney, Agent, or Firm*—Warner Norcross & Judd LLP

(57) ABSTRACT

A textile component includes a pocket or channel woven directly into the textile using a jacquard weaving method. The textile component may be used in a variety of applications for attachment to an article. A pattern may be woven into the textile, and a pocket may be woven into the textile for receiving an insert. The textile may also include one or more channels for attaching the textile to an article. The channels slide over support elements on the article. In addition, a cut line may be woven into the textile to define an intended path for a cutting device.

12 Claims, 8 Drawing Sheets

Fig. 1

TEXTILE COMPONENT

BACKGROUND OF THE INVENTION

The present invention relates to textile components, and more particularly to textile components formed by a jacquard weaving method for covering an article.

Decorative fabrics are well known for use in a wide variety of applications, such as upholsteries for seating applications, office partitions, and accessories. These fabrics are generally woven fabrics that have particular designs, patterns, and colors, depending on the application. The patterns and designs are generally woven into a large web of fabric on a loom, and then cut from the large web into a desired shape. For example, a fabric cover for a seat cushion is commonly woven as two separate panels on the same large web of fabric, with each panel having a desired pattern. The panels are individually cut out of the web and sewn together about their peripheries. A foam cushion may be inserted between the panels before they are completely sewn together, and the entire assembly can be attached to the seat component of a chair.

A variety of methods are known for weaving patterns and designs into a web of fabric. One particular method, known as jacquard, is particularly advantageous because it allows manufacturers to weave intricate patterns and designs into the fabric that are not possible or are extremely difficult when attempted with other weaving methods. Because of these advantages, manufacturers are attaching these fabrics to many different articles, such as the seat cushion described above, in order to improve the aesthetics of these articles and ultimately boost consumer interest. Consequently, they are continually searching for more efficient and cost effective methods for improving the aesthetics of these fabrics and for attaching the fabrics to particular articles.

SUMMARY OF THE INVENTION

The aforementioned problems are overcome by the present invention wherein a pocket or channel is woven directly into a fabric using the jacquard method.

In one embodiment, the fabric is used in seating applications. A design or pattern may be woven into the fabric to cover a seat or a back support. A pocket of a desired size and shape may be woven into the fabric for receiving a cushioning material such as foam. The fabric, including the insert, may be conventionally attached to a particular location on the seat.

In another embodiment, the fabric includes one or more channels for use in a variety of applications. The channels are also woven into the fabric with the jacquard method. In one example, a pair of channels may be woven into a web of fabric, with a panel of fabric extending between them. The channels may be pulled over a pair of upstanding support beams to form a partition for an office environment. The panel that extends between the pair of channels may include a pocket woven into the fabric for receiving an additional material such as an acoustic tile, or a structural member.

In another embodiment, the fabric may include a cut line woven into the fabric to facilitate cutting the pattern or design out of the web of fabric. The cut line is woven into the fabric with a weave that is distinguishable from the rest of the fabric, and is generally located around the periphery of the design or pattern to define the periphery of the pattern and distinguish it from the rest of the fabric web. After the web has been woven, a manufacturer can cut the pattern out of the web by cutting along the cut line.

The present invention provides a textile component with all of the advantages of a jacquard woven fabric, as well as the additional advantages of improved aesthetics and a more efficient and cost effective way of attaching the fabric to an article. The pockets provide manufacturers with an easy way to provide inserts in components, and the channels provide an easy way to attach the fabric to an article by simply sliding the channels over the article. At the same time, the aesthetic value of the fabric is maintained because of the wide variety of intricate designs that can be placed in the fabric with the jacquard method.

These and other objects, advantages, and features of the invention will be more fully understood and appreciated by reference to the detailed description of the current embodiment and the drawings.

DETAILED DESCRIPTION OF THE CURRENT EMBODIMENT

I. First Embodiment

Figure 1:
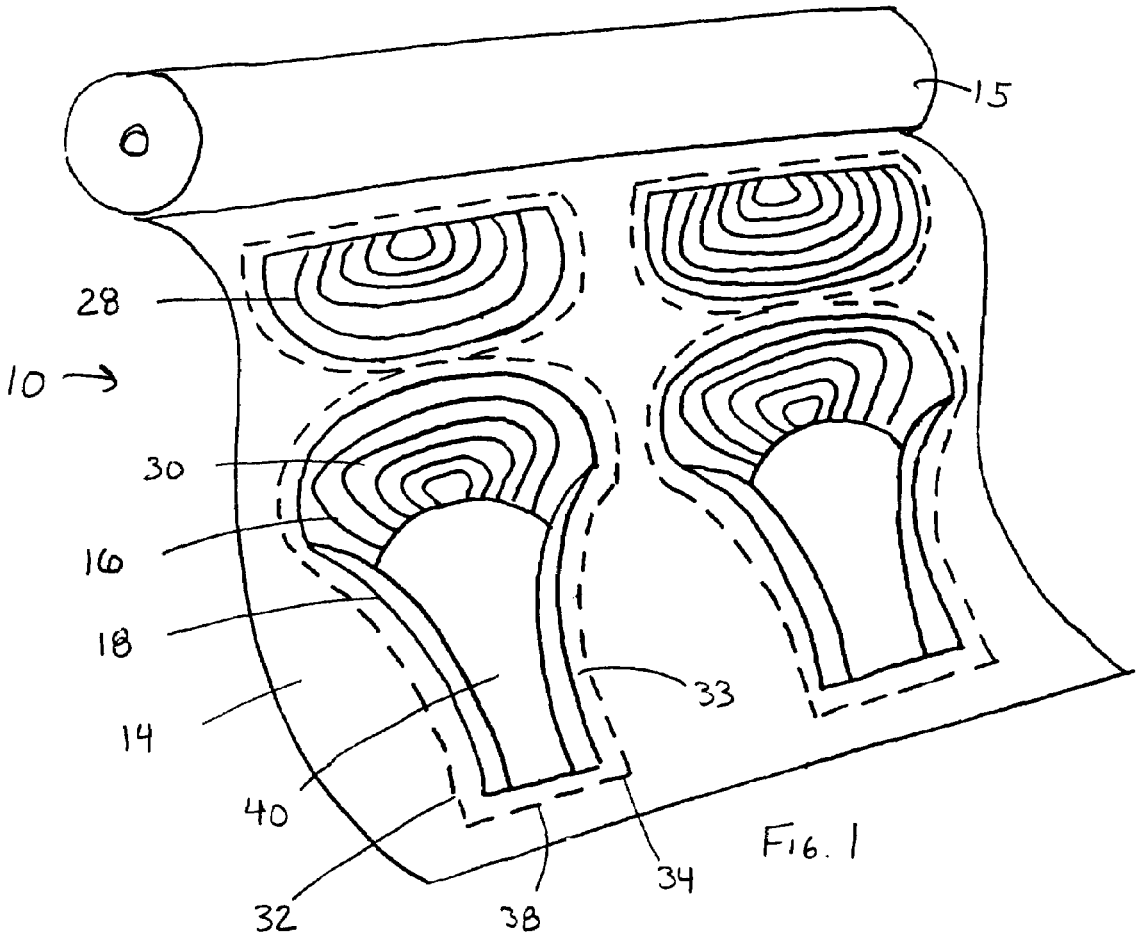
FIG. 1 is a perspective view of a roll of the textile component for attachment to a back support component.

A textile component in accordance with a first embodiment of the present invention is shown in FIG. 1, and generally designated 10. In this embodiment, the textile component is shown in connection with an office chair 12. For illustrative purposes, the component 10 will be described in connection with the particular office chair 12 shown, however, the component 10 is adaptable for use with many different applications, including a variety of seating applications, such as automotive and transportation seating. Shown in FIG. 2, the chair 12 generally includes a base 20, a seat component 22, and a back support component 24.

As shown in FIG. 1, the textile component 10 is generally formed into a web 14. The web 14 may be formed into a variety of shapes and sizes, and generally is formed into an elongated web 14 that can be transported in a roll 15. The textile, or fabric, 10 is generally formed on a loom (not shown) from one of many conventional types of material that are capable of being woven into a fabric. The textile 10 is formed on the loom using a jacquard weaving method. The jacquard method for weaving a web of fabric is well known in the fabric industry, and therefore will not be described in great detail. In short, the jacquard method differs from other methods of weaving fabric in that the warp ends of the material to be woven are independently controlled. This provides greater flexibility in the designs and patterns that can be woven into the fabric. In most modern jacquard weave applications the loom is automated, so that a manufacturer can enter data corresponding to a particular pattern into a central processor, and then actuate the loom to produce a web of woven fabric that matches the data entered. As shown in FIG. 1, a number of patterns 16 are often created on the same web 14 in order to prevent waste and maintain an efficient process.

Figure 3:
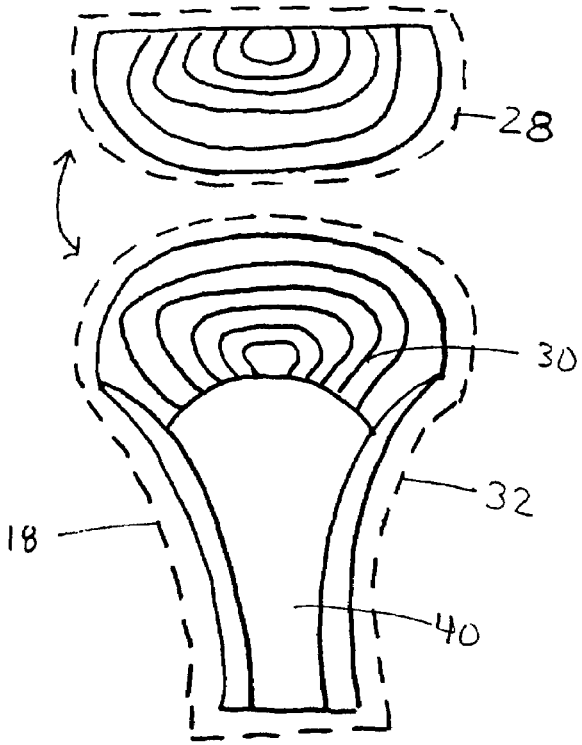
FIG. 3 is a front plan view of the fabric panels in accordance with the first embodiment.

The pattern 16 shown in FIG. 1 is shaped to fit onto the back support component 24 of the office chair 12. As shown, the pattern 16 includes a design 30 of concentric semicircles, however, as mentioned above the jacquard method allows for the inclusion of a wide variety of designs 30. The pattern 16 defines a first panel 18 shaped to fit over a portion of the front surface 26 of the back support 24, and a second panel 28 that is shaped to fit over a portion of the rear surface 31 of the back support 24. The front panel 18 includes a pocket 40 woven into the textile 10. The pocket 40 may be of any desired size or shape. As shown, it is shaped to cover the lower portion of the front panel 18, and extends from the bottom edge 38 of the panel 18. The pocket 40 is woven into the textile with the jacquard method, for instance, by a double-cloth weave in the location of the pocket 40. Shown in FIG. 4, the pocket 40 may be filled with an insert 44 comprised of a variety of materials, such as foam spray, a foam insert cut to the size of the pocket 40, down feathers, or any other desired material. Each panel 18, 28 further includes a periphery 32, that is defined by a cut line 34. The cut line 34 surrounds the periphery 32 and defines a margin 33 between the periphery 32 of the panels 18, 38 and the design 30 included within the panels 18, 38. The cut line 34 is woven into the web 14 such that it can be distinguished from the rest of the web 14 and the design 30. For instance, the cut line 34 may be a different weave or a different color than the rest of the web 14. The cut line 34 facilitates removing the pattern 16 from the web 14 by allowing a manufacturer to cut along with cut line 34 with a conventional tool or machine, such as a scissors or a die cutting machine (not shown). FIG. 3 shows the panels 18, 28 removed from the web 14.

Figure 2:
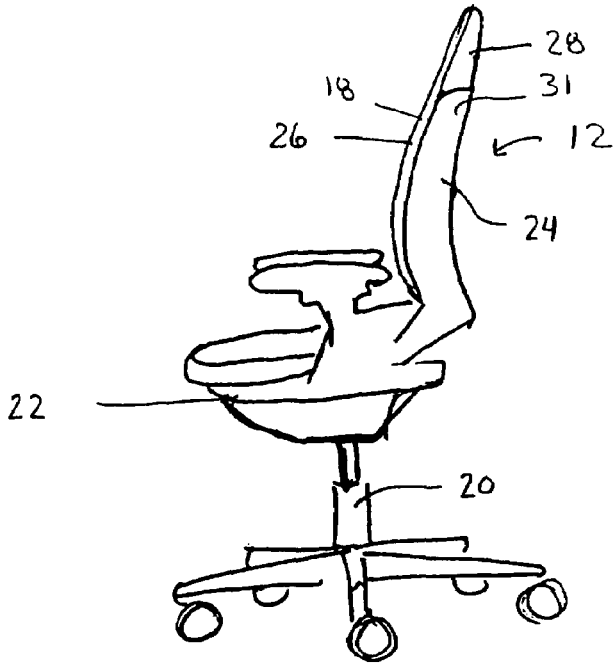
FIG. 2 is a side view of an office chair in accordance with a first embodiment of the present invention.
Figure 4:
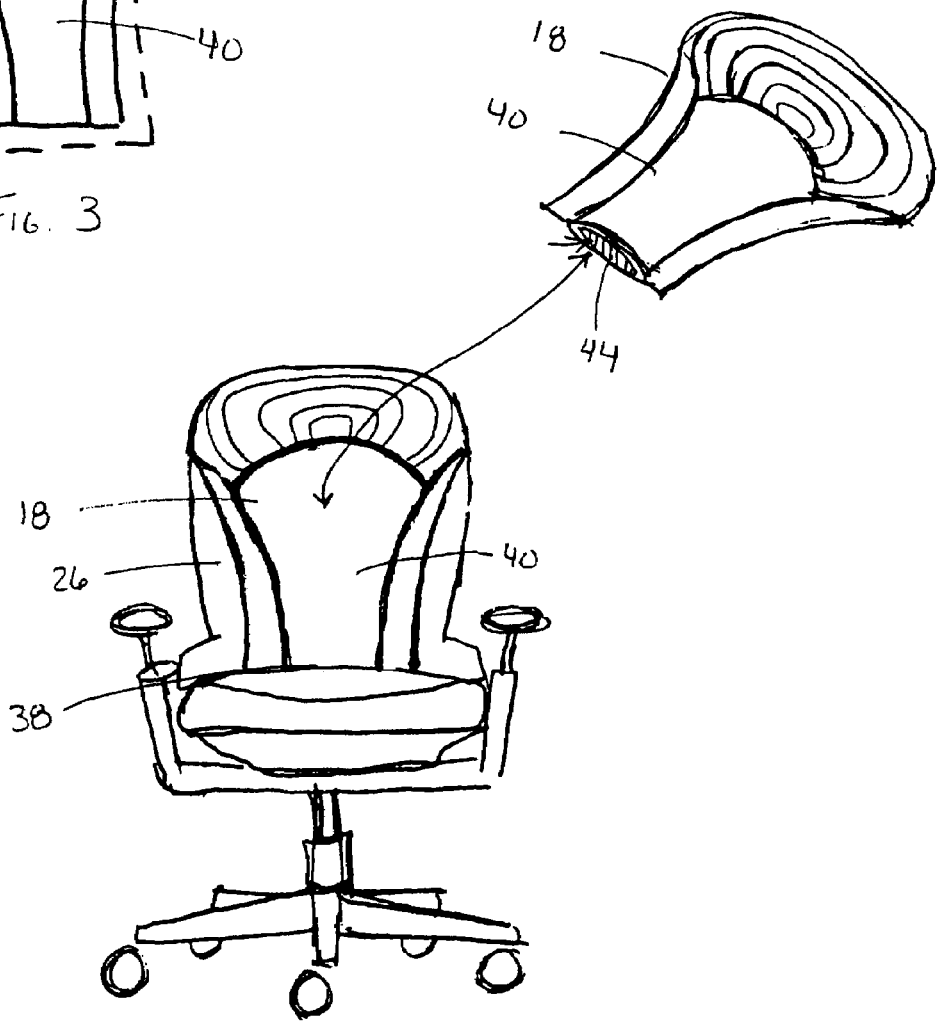
FIG. 4 is a front plan view of the office chair of the first embodiment showing the location of the panels.

FIGS. 2 and 4 show the panels 18, 28 of FIG. 1 attached to the back support component 24 of the office chair 12. In this embodiment, the front panel 18, including the pocket 40 and desired insert 44 are positioned against the front surface 26 of the back support 24, and the lower edge 38 of the panel 18 is attached to the office chair 12 in a conventional manner, such as by sewing a portion of the panel 18 to the back support 24, or with a conventional adhesive or mechanical fastening device (not shown). The back panel 28 is positioned against the rear surface 31 of the back support 24, and the two panels 18, 28 are attached together in a conventional manner, such as by sewing the panels 18, 28 together. Alternatively, the back panel 28 could be eliminated and a second pocket in the shape of the back panel could be woven into the front panel 18 and fitted over the-back support 24.

Figure 5:
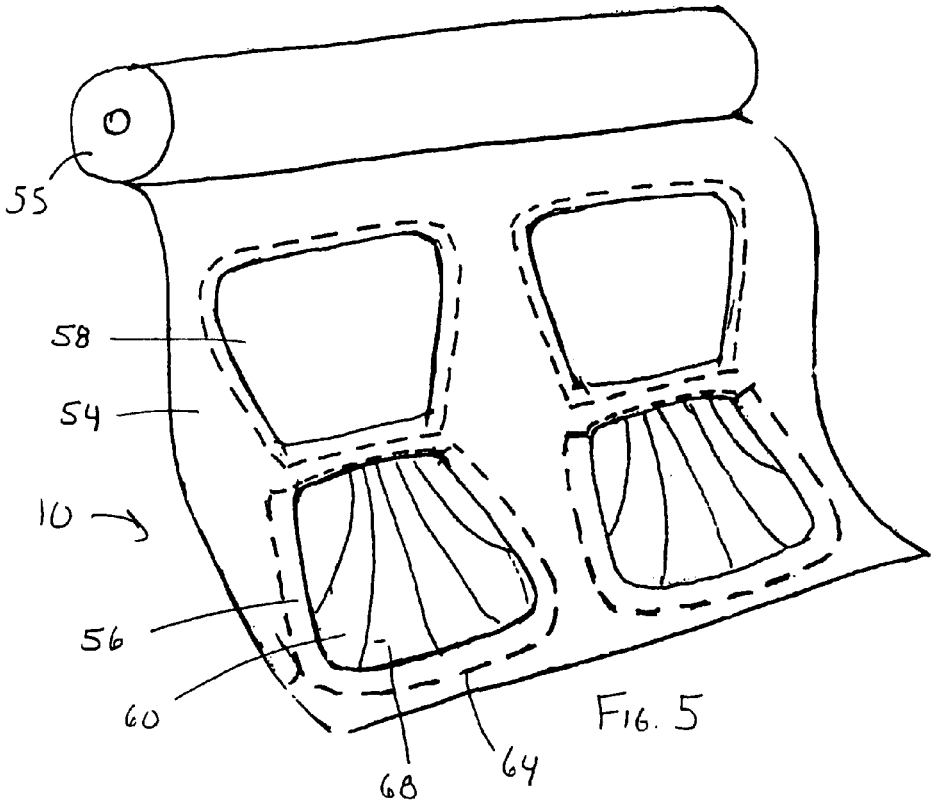
FIG. 5 is a perspective view of a roll of the textile component for attachment to a seat component.
Figure 6:
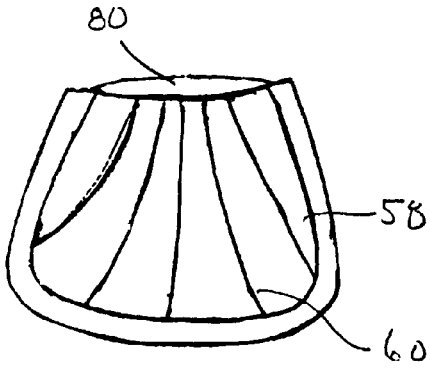
FIG. 6 is a top view of the textile component for attachment to a seat component.

FIGS. 5-10 show the fabric 10 used to cover the seat component 22 of the office chair 12. As shown in FIG. 5, the fabric 10 is created on a web 54 that may be formed into a roll 55. In this case, the pattern 56 includes an upper panel 58 and a lower panel 68. The panels 58, 68 are shaped to cover the seat component 22 of the office chair, and may each include a design 60 and a cut line 64 similar to the design 30 and cut line 34 used with the pattern 16. Referring now to FIG. 6, the pocket 80 may be included in the upper panel 58 and sized to cover approximately all of the panel 58. Alternatively, the pocket 80 could be included in the lower panel 68 or both panels 58, 68. Similar to the pocket 40 on the back support, the pocket 80 may be filled with an insert 84 (shown in FIG. 8) comprised of a variety of different materials, such as a foam cushion.

Figure 7:
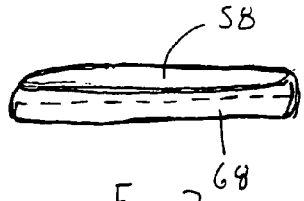
FIG. 7 is a side view of the textile component for attachment to a seat component.
Figure 8:
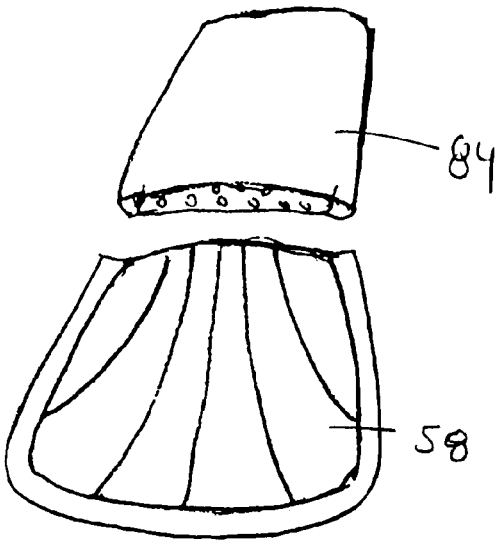
FIG. 8 is an exploded view of the textile component of FIG. 6.
Figure 9:
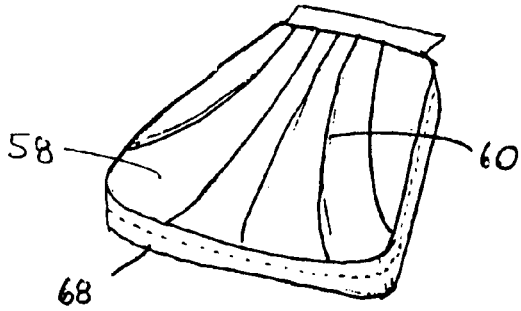
FIG. 9 is a perspective view of the textile component of FIG. 6.
Figure 10:
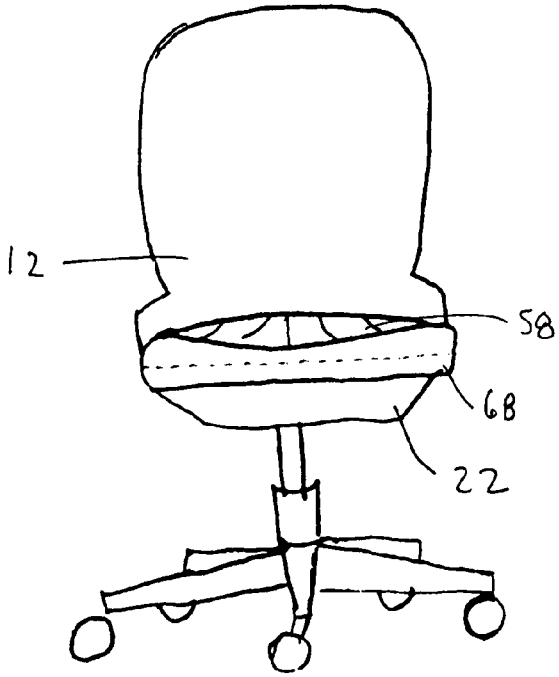
FIG. 10 is a front view of the office chair in accordance with the first embodiment.

As shown in FIGS. 7 and 9, after the panels 58, 68 are removed from the web 54, they may be attached together, for instance, by sewing the panels 58,68 together at their peripheries. Referring now to FIG. 10 the panels 58, 68 are shown attached to the office chair 12. As illustrated, the panels are secured to the seat component 22 of the chair 12 by a conventional method. For instance, the upper panel 58 may be positioned on top of a flat seat plate (not shown), and the lower panel may be stretched around the bottom of the seat plate to cover the seat plate before it is attached to the upper panel 58. Alternatively, the bottom panel 68 may be eliminated and the top panel 58 may be extended around the seat plate or a similar structural member to function as both a cover and a cushion, and may include pockets as needed for any desired inserts.

In addition to the office chair 12 application illustrated, the present invention may be used in a variety of different seating applications, such as different types of chairs or automotive seating, by weaving a web of fabric to have a desired size, shape, design, and pocket, filling the pocket with an insert, and attaching the pocket to the seating application. The component may attach to the seat, for instance, similarly to that described above in connection with the office chair, or by another known method.

II. Second Embodiment

Figure 11:
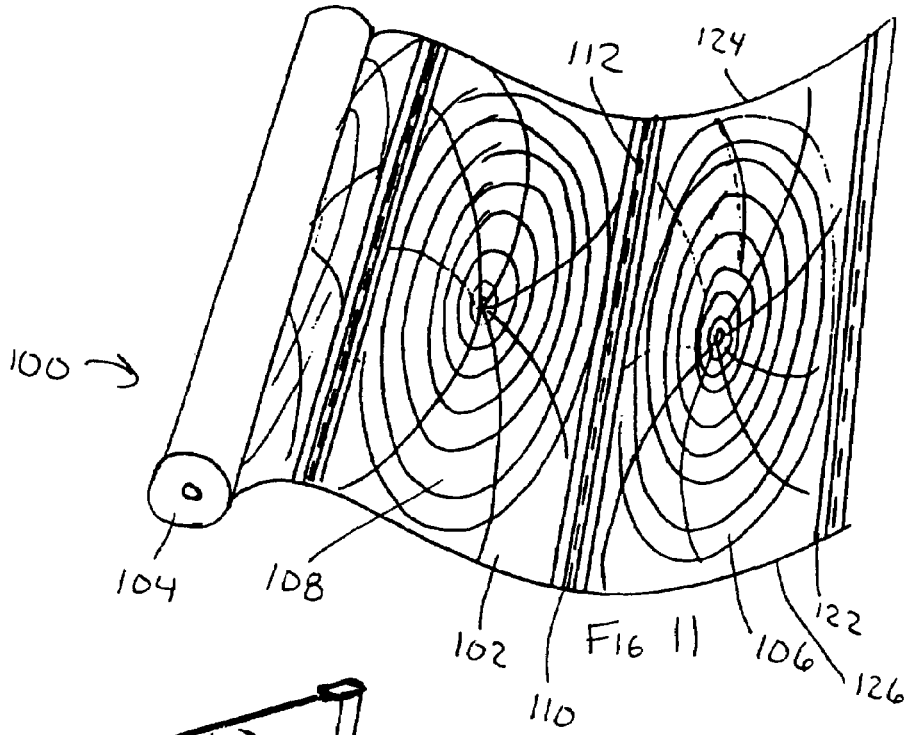
FIG. 11 is a perspective view of a roll of the textile component in accordance with a second embodiment of the present invention.

FIGS. 11-17 show a second embodiment of the present invention, wherein the textile component is attached to a privacy screen. As shown in FIG. 11, the textile 100 is formed by the jacquard method into a web 102 and disposed on a roll 104 similar to that described in the first embodiment. In this case, the web 102 includes a series of repeating patterns 106, that can be divided into panels 120. The patterns 106 may each include a desired design 108, and a periphery 110. The peripheries 110 of each sequential pattern may be separated by a cut line 112. The cut line 112 is similar to the cut lines 34, 64 described in connection with the first embodiment in that it defines the periphery 110 of the pattern and is distinguishable from the rest of the web 102 and the design 108. After the web 102 is formed, the individual panels 120 may be separated by cutting along the cut line 112 with a conventional tool (not shown).

Figure 14:
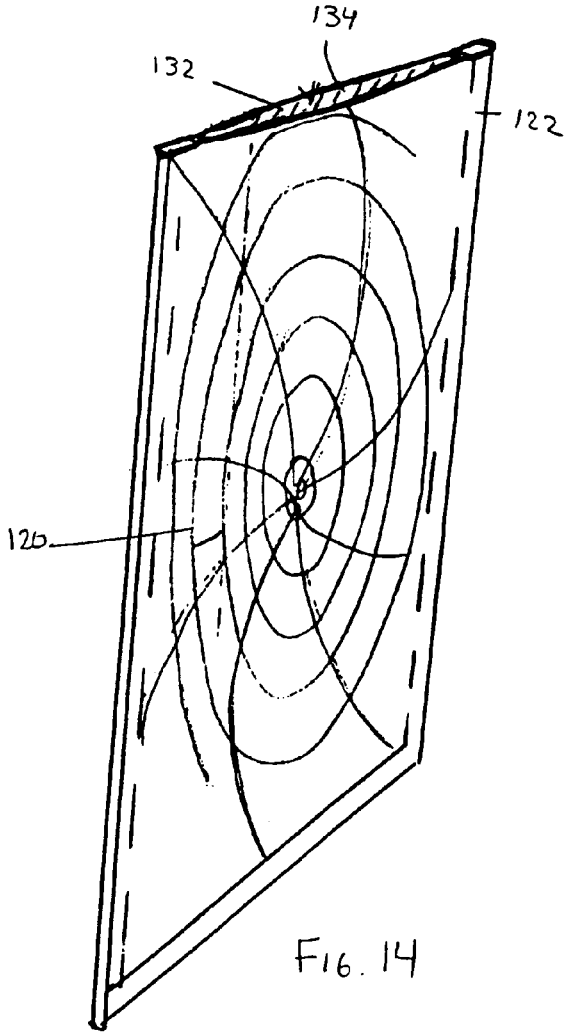
FIG. 14 is a perspective view of the second embodiment including a pocket.
Figure 15:
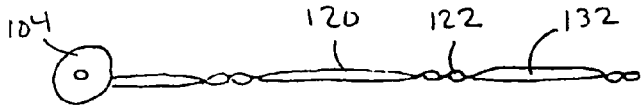
FIG. 15 is a cross sectional view of the textile component of the second embodiment including a pocket.
Figure 16:
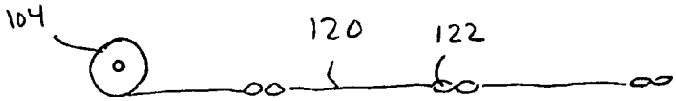
FIG. 16 is a cross sectional view of the textile component of the second embodiment.

Each panel 120 may additionally include a pair of channels 122. As shown, the channels 122 extend from a top edge 124 of the panel 120 to a bottom edge 126 of the panel 120, on opposing sides 128, 130 of the panel 120. Each channel 122 is generally a pocket that extends through the length of the panel 120. The channels are formed by the jacquard method in a similar manner as the pocket of the first embodiment. FIG. 16 shows an exemplary cross section of the panel 120, including channels 122. In addition, as shown in FIGS. 14 and 15, each panel 120 may also include a pocket 132. The pocket 132 is also woven by the jacquard method as described in connection with the first embodiment, and may be of any desired size and shape. As shown, it extends through substantially all of the panel 120 between the channels 122. The pocket 132 may be filled with an insert 134 comprised of a variety of different materials, such as a structural metal, an acoustic tile, or a tack board.

Figure 12:
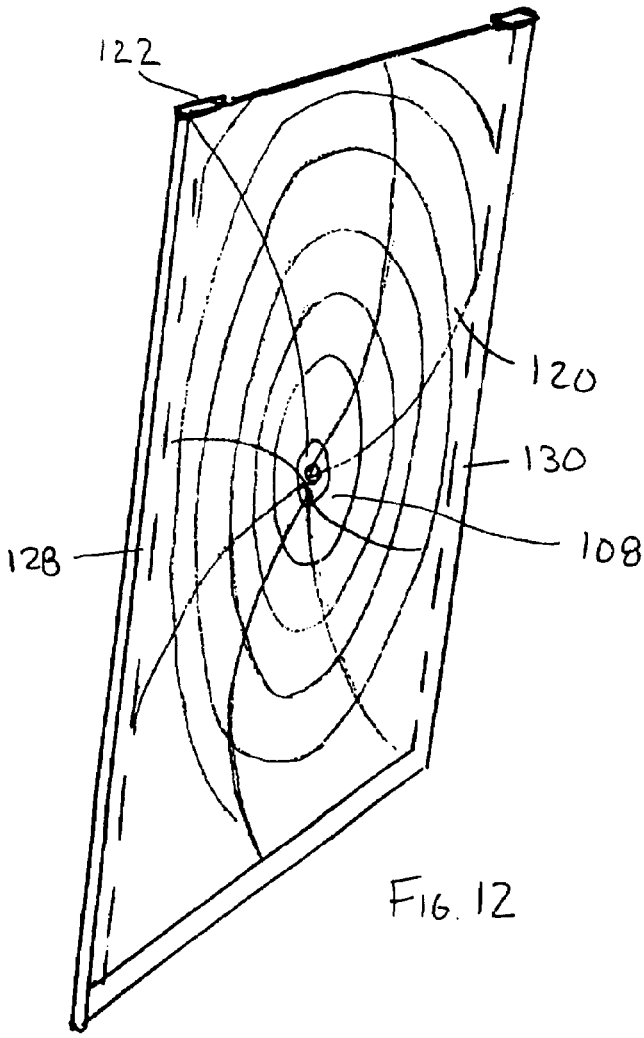
FIG. 12 is a perspective view of privacy screen in accordance with the second embodiment.
Figure 13:
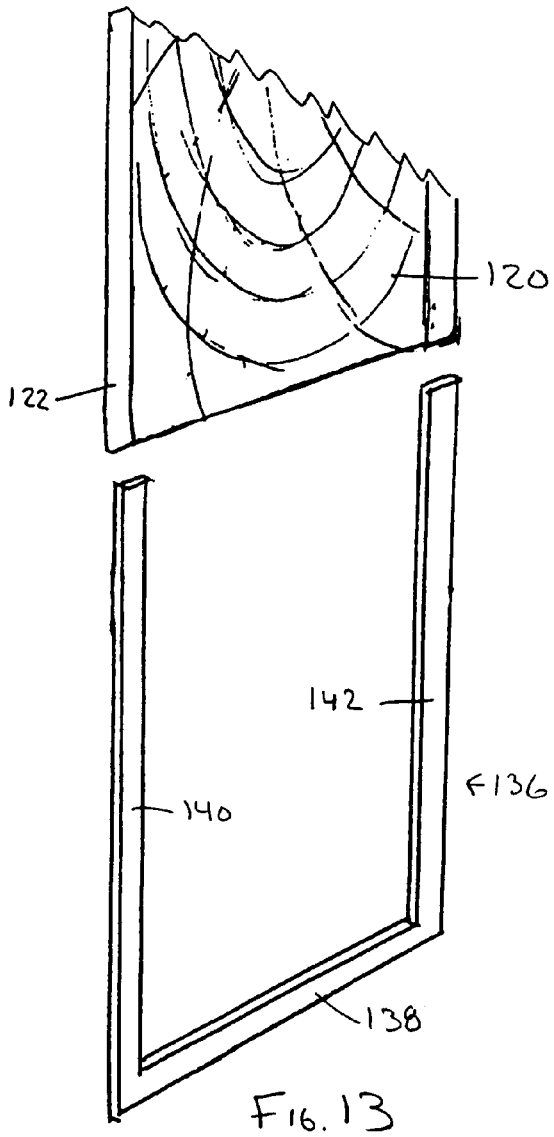
FIG. 13 is an exploded view of the second embodiment.
Figure 17:
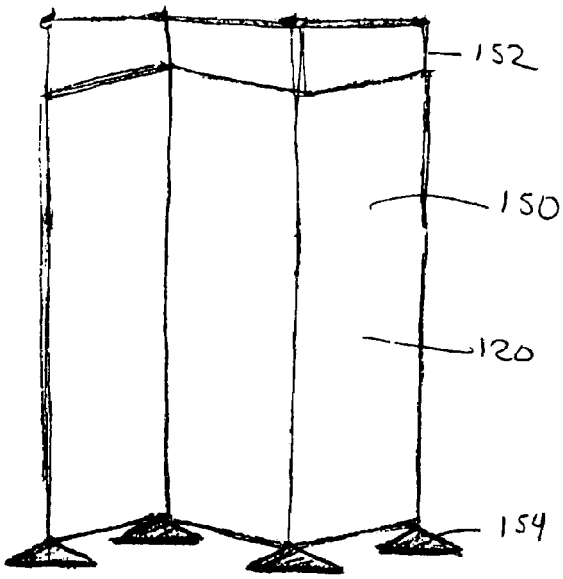
FIG. 17 is a side view of an alternative privacy screen.
Figure 18:
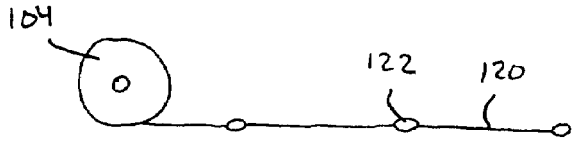
FIG. 18 is a cross sectional view of the textile component of FIG. 17.

As shown in FIGS. 12-14, the panels 120 are designed to attach to a base 136 to form a privacy screen, such as an office partition. The base 136 may include a cross member 138 and a pair of upstanding side beams 140, 142. The panels attach to the base by sliding the channels 122 over the side beams 140, 142. Another embodiment of the privacy screen is shown in FIG. 17. In this embodiment, multiple panels 120 are used to form an elongated screen 150, with multiple beams 152 supported by bases 154. A cross section of the textile 100 of this embodiment is shown in FIG. 18, wherein each panel 120 is separated by only one channel 122, and the cut line (not shown) is included only intermittently between panels 120, depending on the desired length of the screen.

III. Third Embodiment

Figure 19:
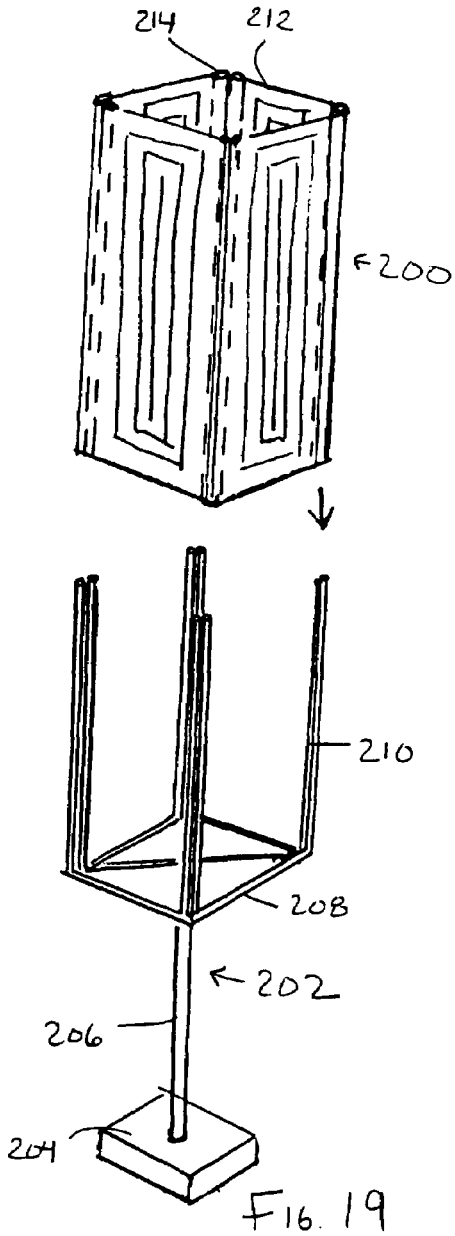
FIG. 19 is an exploded view of a lamp shade in accordance with a third embodiment of the present invention.
Figure 20:
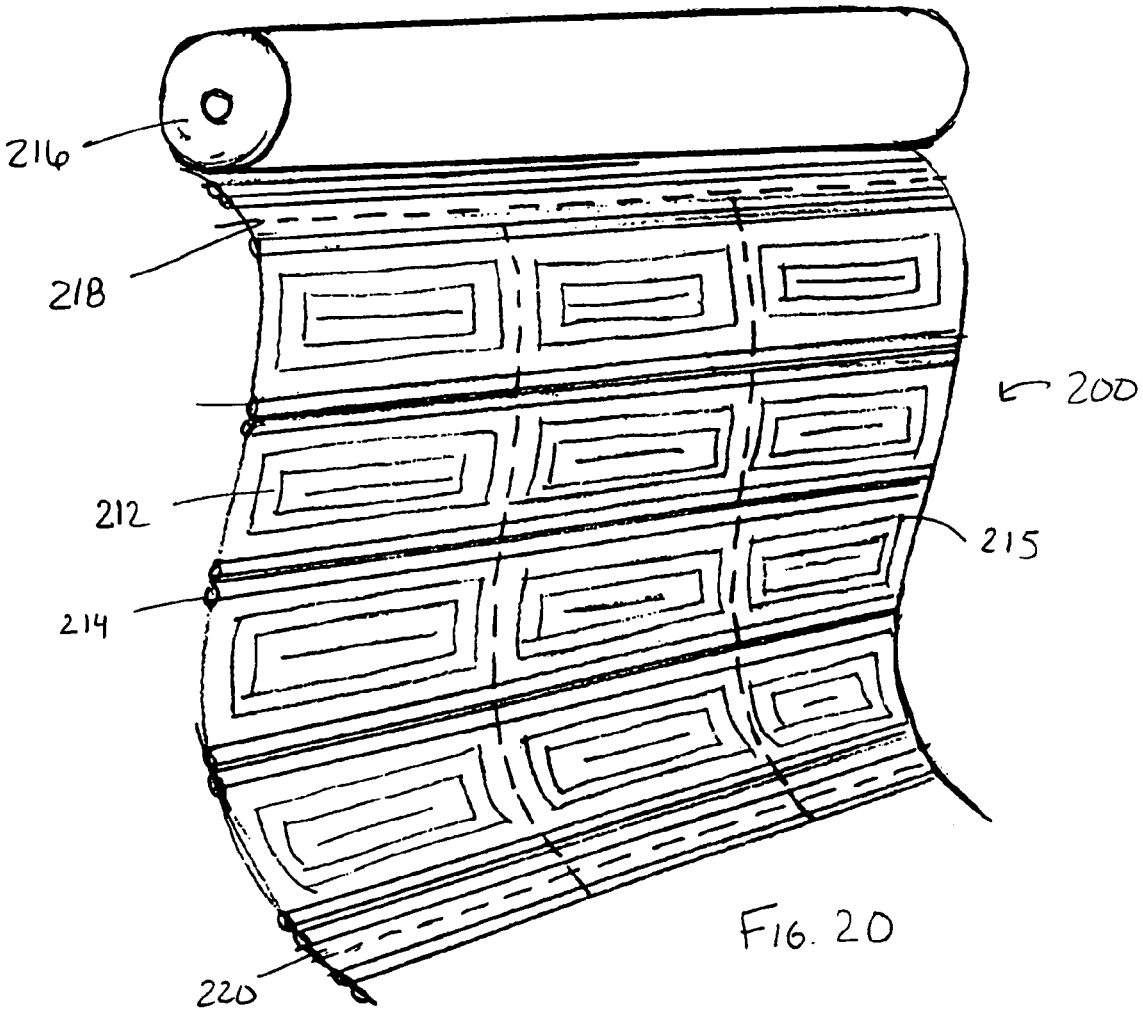
FIG. 20 is a perspective view of the textile component on a roll in accordance with the third embodiment.
Figure 21:
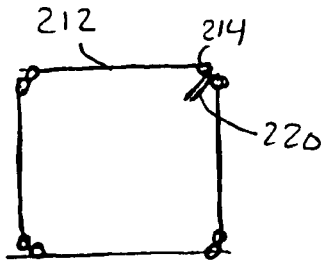
FIG. 21 is a top view of the textile component in accordance with the third embodiment.
Figure 22:
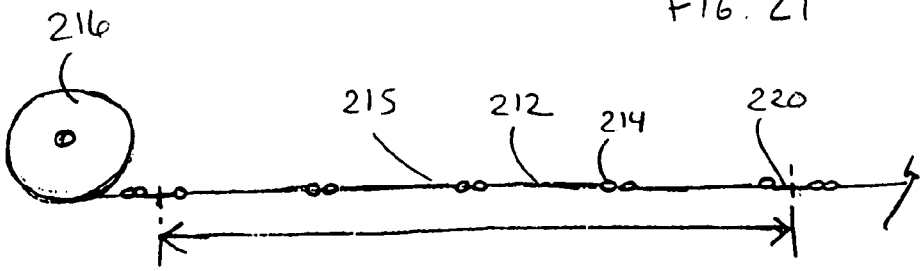
FIG. 22 is a cross sectional view of the textile component of the third embodiment.

A third embodiment of the present invention is shown in FIGS. 19-22. In this embodiment, the textile component 200 is shown attached to a lamp shade base 202. As shown in FIG. 19, the lamp shade base 202 includes a weight 204, a stem 206, four cross members 208 arranged in approximately a square, a pair of upstanding beams 210 extending from each corner of the cross members 208. In order to attach the textile component 200 to the base 202, four panels 212 are positioned in a square, with a pair of channels 214 extending over each pair of beams 210. As shown in FIG. 20, the textile component 200 is formed on a roll 216 similar to the first two embodiments. In this case, the fabric 200 includes cut lines 218 every fourth panel 212 to form a web 215 of sequential panels that will remain connected for attachment to the base 202. Shown in FIG. 21, the cut lines 218 define a margin 220 at the periphery of each web 215. The remaining margin 220 extends inside the lamp shade when the textile 200 is attached to the base 202. FIG. 22 shows a cross sectional view of the textile 200, with cut lines 218 defining the width of the web 215. Each web 215 includes a single channel 214 near the cut line 218, and three pairs of channels 214 inside the web 215 to accommodate for the pairs of upstanding beams 210. Each panel 212 may additionally include a pocket (not shown) of a desired size and shape for accommodating a desired insert. Of course, the lamp shade illustrated is merely exemplary of the many different configurations of lamp shades that are possible with a textile component attached to a base.

The above descriptions are those of current embodiments of the invention. Various alterations and changes can be made without departing from the spirit and broader aspects of the invention, which are to be interpreted in accordance with the principles of patent law including the Doctrine of Equivalents.

The invention claimed is:

1. A web of jacquard woven fabric comprising a first portion and a second portion, said first portion including a multiple layer weave, said second portion including a single layer and forming a periphery of said first portion, said web including a cut line woven into the web, said cut line being distinguishable from the rest of the web including said first portion and said second portion.

2. The web of claim 1 further comprising a pattern woven into the web, said pattern including a decorative design woven into said pattern.

3. The web of claim 2 wherein said pattern is shaped to cover a portion of a chair, said chair including a back support component and a seat component.

4. The web of claim 3 wherein said pattern includes first and second panels, said first panel shaped to cover a majority of a front surface of a back support component of a chair, said second panel shaped to cover an upper portion of a rear surface of a back support component for a chair.

5. The web of claim 4 wherein said first portion is a pocket configured to receive a cushioned insert.

6. The web of claim 5 wherein the web of jacquard woven fabric is a seating cover.

7. A seating article comprising:

at least one seating component;

the seating cover as defined in claim 6; and a cushioned insert inserted within said pocket.

8. The seating article of claim 7 wherein said cut line is distinguishable from the rest of the article by being a separate weave from the rest of the article.

9. The seating article of claim 7 wherein said cut line is distinguishable from the rest of the article by being a different color than the rest of the article.

10. The seating article of claim 7 wherein said seating article includes at least a seat component and a back support component, said cover attachable to one or both said seat component and said back support component.

11. The seating article of claim 10 wherein said seat component includes an upper surface, and said cover is attached to said seat component such that it fits over the upper surface.

12. The seating article of claim 10 wherein said back support component includes a front surface and a rear surface, said pocket covering a majority of said front surface.

* * * * *